US005266934A

United States Patent [19]

Van Almen

[11] Patent Number: 5,266,934

[45] Date of Patent: Nov. 30, 1993

[54] ALPHA-NUMERICAL DISPLAY DEVICE

[75] Inventor: Jacobus J. Van Almen, Eindhoven, Netherlands

[73] Assignee: U.S. Philips Corporation, New York, N.Y.

[21] Appl. No.: 996,351

[22] Filed: Dec. 23, 1992

Related U.S. Application Data

[63] Continuation of Ser. No. 829,513, Jan. 30, 1992, abandoned, which is a continuation of Ser. No. 529,072, May 25, 1990, abandoned.

[30] Foreign Application Priority Data

Sep. 28, 1989 [NL] Netherlands ..... 8902412

[51] Int. Cl.[5] ..... G09G 3/18

[52] U.S. Cl. ..... 345/50; 345/55

[58] Field of Search ..... 340/756, 765, 752, 759, 340/784, 774, 763; 40/447, 448, 450

[56] References Cited

U.S. PATENT DOCUMENTS

| | | | |
|---|---|---|---|
| 3,897,643 | 8/1975 | Morris, Jr. et al. | 340/756 |
| 4,654,652 | 3/1987 | Cerruti | 340/756 |
| 4,949,081 | 8/1990 | Keller et al. | 340/756 |

FOREIGN PATENT DOCUMENTS

| | | | |
|---|---|---|---|
| 0159068 | 10/1985 | European Pat. Off. . | |
| 3816550 | 11/1989 | Fed. Rep. of Germany | 340/756 |

*Primary Examiner*—Ulysses Weldon
*Assistant Examiner*—Doon Yue Chow
*Attorney, Agent, or Firm*—Norman N. Spain

[57] ABSTRACT

In an alpha-numerical display the segments are split up into (interconnected) sub-segments in such a way that characters can always be displayed in a manner analogous to that for a conventional matrix display. This provides the advantages of a great freedom of choice of characters with a drive mode (1:n multiplexing, n≦4) yielding a large viewing angle and a high contrast.

6 Claims, 5 Drawing Sheets

| | | | | |
|---|---|---|---|---|
| 30 aa | 30 ab | 30 ac | 30 ad | 30 ae |
| 30 ba | 30 bb | 30 bc | 30 bd | 30 be |
| 30 ca | 30 cb | 30 cc | 30 cd | 30 ce |
| 30 da | 30 db | 30 dc | 30 dd | 30 de |
| 30 ea | 30 eb | 30 ec | 30 ed | 30 ee |
| 30 fa | 30 fb | 30 fc | 30 fd | 30 fe |
| 30 ga | 30 gb | 30 gc | 30 gd | 30 ge |

FIG.2

ALPHA-NUMERICAL DISPLAY DEVICE

This is a continuation of application Ser. No. 07/829,513 filed Jan. 30, 1992 is now abandoned, and which is a continuation of application Ser. No. 07/529,072, filed on May 25, 1990.

BACKGROUND OF THE INVENTION

The invention relates to a display device for displaying alpha-numerical characters, which device comprises an electro-optical material between a first supporting plate having at least one electrode and a second supporting plate having a plurality of electrode segments.

A display device of this type is known from U.S. Pat. No. 3,781,864. In this Patent a liquid crystal display device is shown with a counterelectrode on the one supporting plate and 7 electrode segments for each character on the other supporting plate, and it describes the drive mode for such a display device. Substantially only numerals are shown while using the so-called direct drive method. In this drive method a segment to be visualized is continuously driven, while the polarity of the drive voltage is periodically changed so as to prevent degradation of the liquid crystal. Therefore, a separate connection is required for each electrode segment.

It has been possible to reduce the number of required connections in such display devices by splitting up the undivided electrode into two or more parts and by ensuring the drive mode by way of multiplex drive (1:2 multiplexing, 1:3 or 1:4 multiplexing). Notably at a higher multiplex degree (5 or more) this leads to a more complicated drive mode as well as to a lower effective drive voltage across the picture segments to be driven. Notably when using liquid crystalline material as an electro-optical medium, such a lower effective voltage leads to a decrease of the viewing angle. The contrast also deteriorates at a multiplex degree of more than 4.

Since the shape of the segment electrodes is fixed, the variation of characters to be displayed is also limited in this case.

The latter is much less the case if the characters are composed of elements arranged in accordance with a matrix, for example, n rows and m columns defining nxm character elements. As n and m increase, the characters can be fixed more accurately. However, this requires a complicated drive circuit (1:n multiplexing), while the effective voltage may even further decrease due to the lower duty cycle (1/n) (n is generally high, for example, $n \geqq 8$).

OBJECTS AND SUMMARY OF THE INVENTION

It is one of the objects of the invention to provide a display device of the type described in the opening paragraph in which the advantages of a drive mode using a low multiplex degree (up to 1:4) and a display device based on the matrix principle are combined as much as possible.

To this end a display device according to the invention is characterized in that the electrode segments comprise sub-segments most of which are substantially square-shaped, rectangular or parallelogram-shaped and occupy at least a part of character element spaces arranged in the form of a matrix.

The matrix is preferably located on the second supporting plate and preferably has at least twelve electrode segments, and the square-shaped, rectangular or parallelogram-shaped sub-segments preferably occupy the majority of the character element spaces.

The use of a low multiplex degree yields a large viewing angle and a high contrast, while the division into sub-segments gives the device a structure which with the division of the sub-segments according to the invention leads to a wide range of characters to be displayed.

BRIEF DESCRIPTION OF THE DRAWINGS

The invention will now be described in greater detail by way of example with reference to the accompanying drawings in which FIG. 2 shows schematically a matrix of spaces for character elements corresponding to the electrode segments of FIG. 1;

DESCRIPTION OF THE PREFERRED EMBODIMENT

Figure 1:
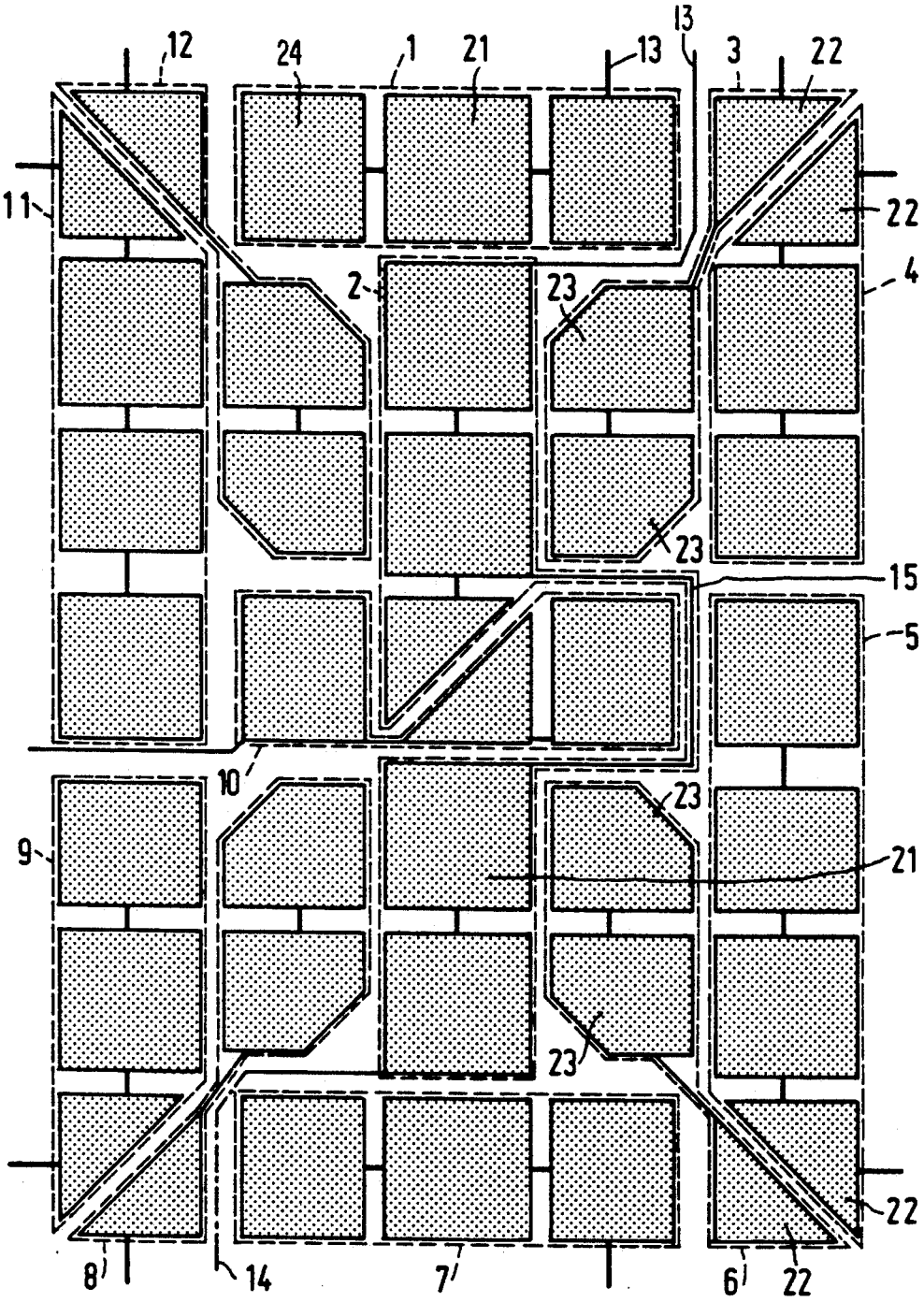
FIG. 1 shows diagrammatically the matrix division according to the invention of an electrode of an alphanumeric display device into a plurality of electrode segments.

FIG. 1 shows diagrammatically the division of the electrode segments 1, 2, 3, . . . , 12 on one of the supporting plates of a display device. The device also comprises another supporting plate having one or more counterelectrodes (at most 4), while an electro-optical material, for example, a liquid crystalline medium is present between the two supporting plates. The boundaries of the different electrode segments 1, 2, 3, . . . , 12 are denoted by means of broken lines in FIG. 1.

According to the invention the electrode segments are divided into sub-segments 21, 22, 23, and 24, which sub-segments are formed in such a way that they substantially entirely cover one of the character element spaces 30 on their own or together with other sub-segments, as is shown in FIG. 2.

For example, electrode segment 1 comprises three substantially square-shaped sub-segments 21 in this embodiment, which sub-segments correspond to the character elements occupying spaces $\mathbf{30}^{ab}$, $\mathbf{30}^{ac}$, $\mathbf{30}^{ad}$ in FIG. 2.

Electrode segment 2 comprises four substantially square-shaped sub-segments 21, which correspond to the character elements in spaces $\mathbf{30}^{bc}$, $\mathbf{30}^{cc}$, $\mathbf{30}^{ec}$ and $\mathbf{30}^{fc}$, as well as a connection track 15, which connects the sub-segments 21 associated with the spaces $\mathbf{30}^{cc}$ and $\mathbf{30}^{ec}$, and a triangular sub-segment 22 which together with a triangular sub-segment 22 associated with space $\mathbf{30}^{dc}$. Triangular sub-segment 22 of electrode segment 10 also occupies space $\mathbf{30}^{dc}$. Electrode segment 3 comprises a triangular sub-segment 22 which together with a triangular sub-segment 22 associated with electrode segment 4 substantially entirely covers the space $\mathbf{30}^{ae}$. Furthermore, the electrode segment 3 comprises two pentagonal sub-segments 23 at the locations $\mathbf{30}^{bd}$, $\mathbf{30}^{cd}$, while electrode segment 4 further comprises two substantially square-shaped sub-segments 21 at the locations $30^{be}$ and $30^{ce}$. Similarly, electrode segment 5 comprises two substantially square-shaped sub-segments 21, as rectangular-shaped sub-segment 24, and a triangular sub-segment 22, which together with a triangular sub-segment 22 of electrode segment 6 again substantially entirely covers the space $30^{ge}$, while electrode segment 6 further comprises two pentagonal sub-segments 23.

Electrode segment 7 comprises one substantially square-shaped sub-segment 21 and two rectangular sub-segments 24. The electrode segments 8 and 9 can be described similarly as the electrode segments 3 and 4. In addition to the mentioned triangular sub-segment 22, the electrode segment 10 comprises two substantially rectangular sub-segments 24. The electrode segments 11 and 12 may be described similarly as the electrode segment 5 and 6.

In the above-described configuration with twelve electrode segments the substantially square-shaped and rectangular sub-segments occupy the majority of the spaces 30 (22 out of 35).

The electrode segment have connection conductors 13 for external connections. If desired, the electrode segment 2 may be connected at two ends, which is shown diagrammatically by means of the solid line 13 and the dot-and-dash line 14.

Figure 3:
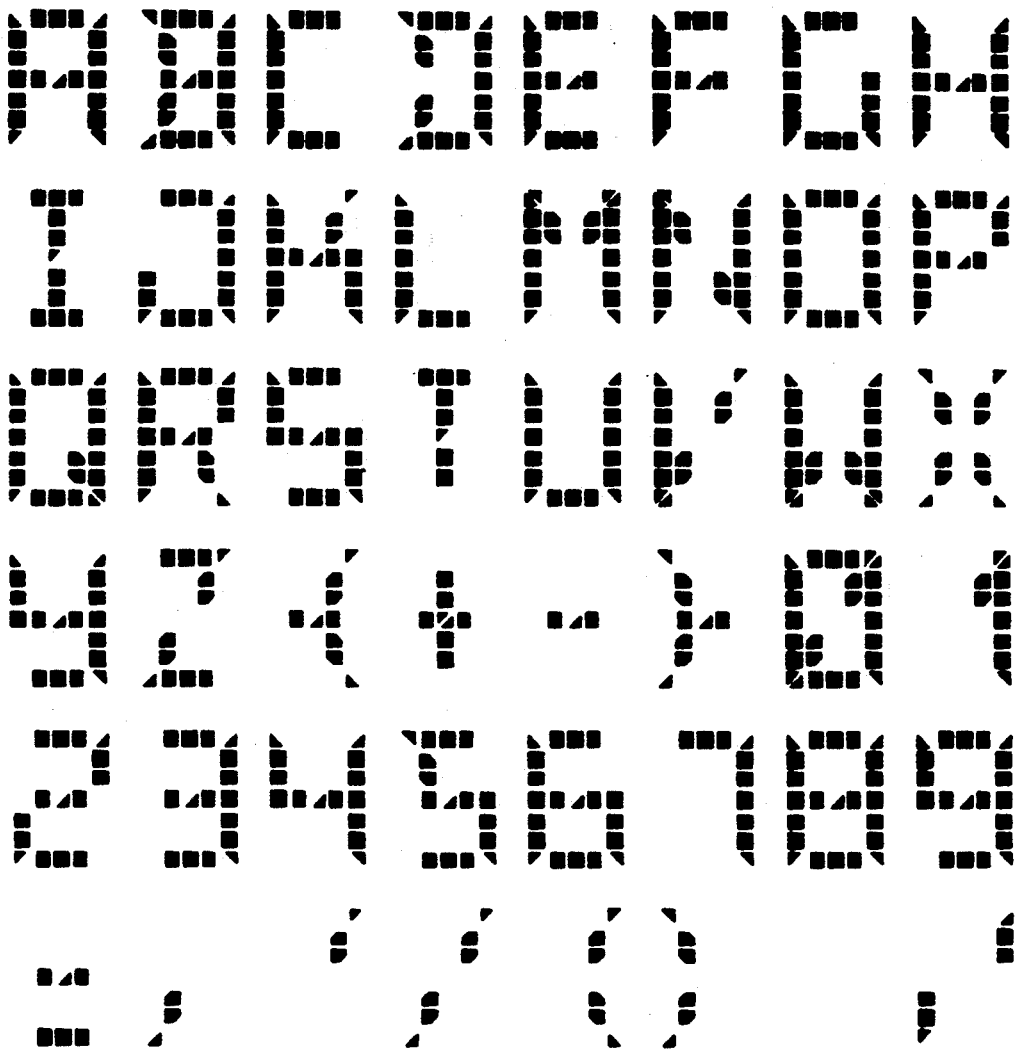
FIG. 3 shows the display of each of a plurality of alpha-numerical characters by means of a display device having the matrix division of FIG. 1.

Since the electrode segments can be driven directly or with a low multiplex degree in a known way (by means of a selection circuit), a large viewing angle and a high contrast may be obtained when using such a matrix in a liquid crystal display device. A satisfactory display of alpha-numerical characters can be obtained by means of the sub-division into sub-segments. A plurality of such characters is shown in FIG. 3 for the purpose of illustration.

Figure 4:
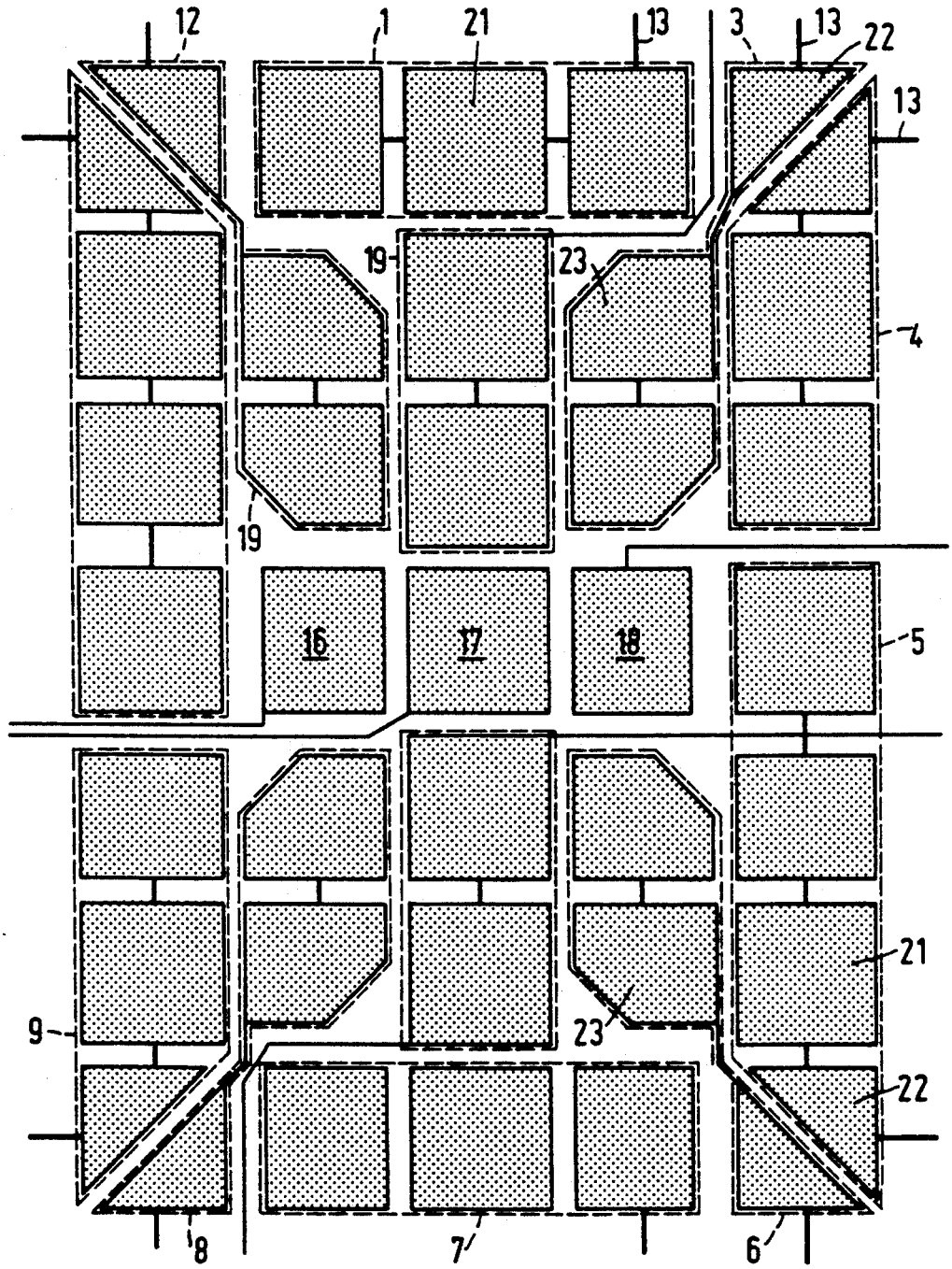
FIG. 4 shows another division of a plurality of electrode segments according to the invention.
Figure 5:
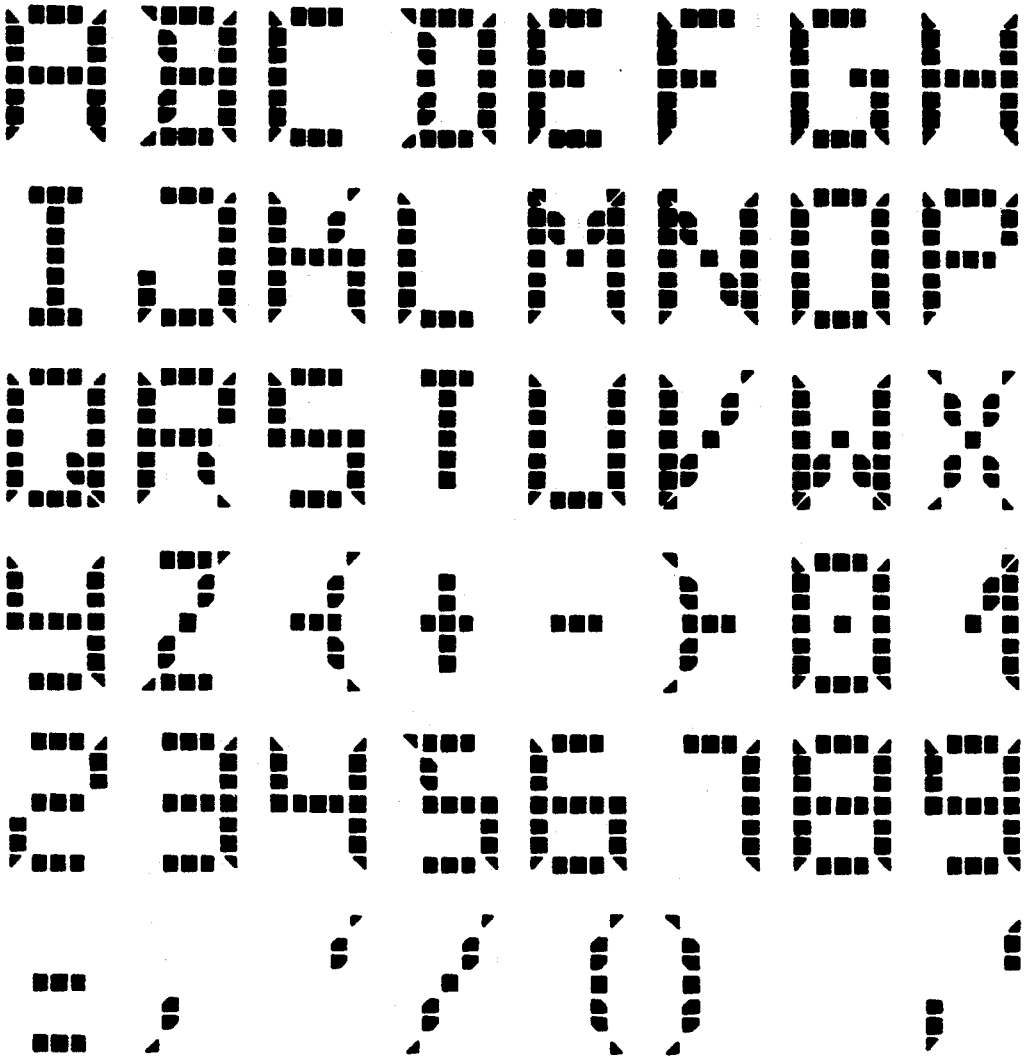
FIG. 5 shows the display of alpha-numerical characters associated with the division of FIG. 4.

Another division with fifteen electrode segments is shown in FIG. 4. The electrode segments 1, 3, 4, 5, 6, 7, 8, 9, 11 and 12 are comparable to those in FIG. 1. Instead of the electrode segments 2, 10, the device according to FIG. 4 now has electrode segments 16, 17, 18 each comprising one sub-segment and occupying the spaces $30^{db}$, $30^{dc}$ and $30^{dd}$, as well as the electrode segments 19 and 20, each electrode comprising two square-shaped sub-segments 21 occupying the spaces $30^{bc}$, $30^{cc}$ and $30^{ec}$, $30^{fc}$, respectively. For the purpose of illustration, FIG. 5 shows a plurality of characters displayed by means of a sub-division of (sub-) segments according to FIG. 4.

The invention is of course not limited to the examples shown, but many other shapes, notably of the sub-segments 21, are possible, for example, rectangular or parallelogram shapes. Different distributions of the sub-segments over the electrode segments are alternatively possible.

I claim:

1. An alpha-numerical display comprising at least one character, said character comprising on a substrate seven rows of five generally square-shaped, rectangular or parallelogram-shaped electrode segments in five columns in which each segment of the second row is interconnected to the corresponding segment of the third row and each segment of the fifth row is interconnected to the corresponding segment of the sixth row, characterized in that each corner section comprises two triangular subsegments separated along the diagonal direction from the corresponding corner of the character, one of said triangular subsegments being connected to two or more segments of the same column, the other triangular subsegment being connected to two or more mutually interconnected segments in the next two tows of the column next to said same column.

2. The alpha-numerical display of claim 1 wherein the fourth row comprises separate electrode segments in the second, third and fourth column.

3. The alpha-numerical display of claim 1 wherein the segment in the fourth row and the third column comprises two triangular segments separated along the diagonal from lower left to upper right, one of said triangular subsegments is connected to two interconnected segments of the third column in the second and third row and the other triangular subsegment is connected to segments of the second and fourth column in the fourth row.

4. An alpha-numerical display comprising at least one character, said character comprising on a substrate seven rows of five generally square-shaped, rectangular or parallelogram-shaped electrode segments in five columns in which each segment of the second row is interconnected to the corresponding segment of the third row and each segment of the fifth row is interconnected to the corresponding segment of the sixth row, characterized in that each corner section comprises two triangular subsegments separated along the diagonal direction from the corresponding corner of the character, one of said triangular subsegments being connected to two or more interconnected segments of the same column, the other triangular subsegment being interconnected to two mutually interconnected segments in the next two rows of the column next to said same column, each of said segments in said mutually interconnected segments having a pentagonal shape with four edges parallel to the edges of the character and a fifth edge parallel to said diagonal direction at sides away from the mutual interconnection between said two segments.

5. The alpha-numerical display of claim 4 wherein the fourth row comprises separate electrode segments in the second, third and fourth column.

6. The alpha-numerical display of claim 4 wherein the segment in the fourth row and the third column comprises two triangular subsegments separated along the diagonal from lower left to upper right, one of said triangular subsegments is connected to two interconnected segments of the third column in the second and third rows and the other of said triangular subsegments is interconnected to segments of the second and fourth column in the fourth row.

* * * * *